US005263798A

United States Patent [19]

Dupeuble et al.

[11] Patent Number: 5,263,798

[45] Date of Patent: Nov. 23, 1993

[54] PROCESS FOR GUIDING THE EXCAVATION TOOL USED FOR THE CONSTRUCTION OF A WALL CAST IN THE GROUND, AND EXCAVATION TOOL FOR IMPLEMENTING THIS PROCESS

[75] Inventors: Paul Dupeuble, Noisy Le Roi; Jacques Charlier, Ivry Sur Seine; Jean Claude Gessay, Roissy En Bry, all of France

[73] Assignee: Societe anonyme dite Sondages Injections Forages "S.I.F." Entreprise Bachy, France

[21] Appl. No.: 868,877

[22] Filed: Apr. 16, 1992

[30] Foreign Application Priority Data

Apr. 19, 1991 [FR] France ..... 91 04847

[51] Int. Cl.[5] ..... E02D 3/02

[52] U.S. Cl. ..... 405/287; 405/287.1; 405/284

[58] Field of Search ..... 405/267, 266, 263, 287, 405/287.1, 284

[56] References Cited

U.S. PATENT DOCUMENTS 4,861,199 8/1989 Hackmack ..... 405/267
4,909,674 3/1990 Konno et al. ..... 405/267
4,930,940 6/1990 Charlier et al. .
5,056,242 10/1991 Miotti ..... 405/287 X
5,056,959 10/1991 Cannac et al. ..... 405/267

FOREIGN PATENT DOCUMENTS 0101350 2/1984 European Pat. Off. .
0333577 9/1989 European Pat. Off. .
2617881 2/1989 France .

*Primary Examiner*—Dennis L. Taylor
*Assistant Examiner*—J. Russell McBee
*Attorney, Agent, or Firm*—Stevens, Davis, Miller & Mosher

[57] ABSTRACT

Process for guiding the excavation tool used in order to execute the trenches necessary for the construction, by successive or alternating panels, of a wall cast in the ground, according to which:

a) an excavation tool fitted with a first guiding element is provided,
b) at the end of a previously executed trench, a second guiding element is arranged extending substantially over the entire depth of this trench, and then
c) after construction of the panel in the previously executed trench, the guiding elements are mutually engaged; and
d) the excavation tool is controlled so as to create a force tending to keep the guiding elements mutually engaged while the excavation of the following trench is performed.

13 Claims, 3 Drawing Sheets

PROCESS FOR GUIDING THE EXCAVATION TOOL USED FOR THE CONSTRUCTION OF A WALL CAST IN THE GROUND, AND EXCAVATION TOOL FOR IMPLEMENTING THIS PROCESS

BACKGROUND OF THE INVENTION

The invention relates to a process for guiding the excavation tool used for the construction of a wall cast in the ground, and also to a useful modified excavation tool for implementing this process.

Walls cast in the ground are executed by alternating or successive elementary panels. The finished work therefore consists of a succession of unitary panels whose geometrical continuity it is imperative to be able to guarantee in the course of execution.

In order to achieve this geometrical continuity of execution, two methods are used independently or jointly.

The first consists in giving to the excavation tools (mechanical or hydraulic grabs in the case of a discontinuous excavation and extraction of the spoil, or cutters with bull wheel or with chains, or rotary cutters in the case of a continuous excavation and extraction) a body of great height and of cross section very close to the cross section of excavation, so as to produce, in conjunction with the lowering of the center of gravity, a self-guiding on the excavation per se in the course of execution. Monitoring and correction devices may be incorporated in the excavation tools so as to correct more or less effectively any possible deviation with respect to the nominal trajectory.

The second consists in guiding the excavation tool more or less effectively in relation to the panel previously executed. In the conventional wall execution method in very general use a shuttering is put in place at the panel end before concreting is extracted as a sliding shuttering before the concrete has completely set. The gap thus made enables a certain guiding of the excavation tool to be ensured at the time of execution of the following panel.

These fairly approximate methods of guiding are acceptable only in the case of the construction of cast walls of relatively small depth.

Now, the use of cast walls for the construction of Civil Engineering Works at increasing depths (possibly in excess of 100 meters for example) and in increasingly difficult terrain has created the need for a technology of execution which makes it possible to guarantee a priori the geometry and the continuity of the constituent elementary panels. The currently available solutions which are acceptable down to a certain depth are unsatisfactory for deeper works or works requiring a higher degree of safety.

Furthermore, European Patent No. 0,101,350 describes a specific process for extraction of the end shuttering by removing the lateral shuttering which also enables the effective guiding of the excavation tool to be ensured at the same time. However the guiding function of this device is subordinate to its simultaneous shuttering removal, the primary subject of the invention described. In addition, this guiding process is based fundamentally on the sliding of two members, the one in the other. Experience shows that its correct functioning, despite which the risks of jamming and of final locking are not completely avoided, requires a dynamic operation, for example by to-and-fro movement or driving of the excavation tool, given the adverse conditions constituted by the medium heavily loaded with solid particles in suspension coming from the ground in which the entire assembly is immersed. This system is therefore well suited to the case where grabs are used as the excavation tool, but is less suitable in the case where continuous excavation tools such as wall cutters are used.

SUMMARY OF THE INVENTION

The present invention arms to a new process for guiding the excavation tool used for the construction of a wall cast in the ground which makes it possible to prevent any discontinuity between the successive panels of a wall cast in the ground, while being simple to implement.

In particular, the guiding process of the invention is designed to avoid or to overcome the difficulties created by the invasion of the guiding means used by a setting material, such as concrete or cement grout, which invasion creates obstacles hindering the correct operation of said guiding means. These obstacles are the cause of the practical failure of most of the sophisticated guiding systems which were conceivable in the past.

The invention relates to a process for guiding the excavation tool used in order to execute the trenches necessary for the construction, by successive or alternating panels, of a wall cast in the ground, characterized in that:

a) an excavation tool fitted with a first guiding means is provided, b) at the end of a previously executed trench, a second guiding means is arranged extending substantially over the entire depth of this trench, said first and second guiding means being such that one of said means can slide freely in the other and that they can be mutually engaged and disengaged freely over the entire length of the second guiding means; and then c) after construction of the panel in the trench previously executed, the guiding means are engaged; and d) the excavation tool is controlled so as to create a force tending to keep the guiding means mutually engaged while the excavation of the following trench is carried out.

According to one embodiment, the first means, securely attached to the excavation tool, consists of a vertical member, of flat general shape, such as a plate of iron or of steel, and the second guiding means, provided in a sacrificed member securely attached to the end of the previously executed panel or in a temporary shuttering joined to said end, consists of a slot or groove extending vertically over the height of said member or shuttering and in the vicinity of the central part of the latter.

According to another embodiment, the guiding means consist of two vertical members, of flat general shape, spaced apart, parallel to one another, securely attached to the excavation tool, and coming to engage, respectively, in two slots provided between the edges of a sacrificed member securely attached to the end of the previously executed panel or of a temporary shuttering joined to the latter and the neighboring ground.

The second guiding means (slot or groove), since it is put into place before the pouring of the preceding panel is performed, is exposed to an invasion by a setting material such as concrete or cement grout, capable of passing round the sacrificed member or the shuttering, which invasion creates more or less localized obstructions of this second guiding means which would hinder or prevent the free sliding of the first guiding means in the second. It is therefore essential:

either to oppose any possible invasion of this slot by a setting material at the time of concreting the preceding panel;

or to be able to dispose of possible obstacles formed by the setting material having invaded the slot at the time of execution of the preceding panel and having set therein.

In order to oppose any possible invasion a closing of the slot can be performed which may affect the greater part of its cross section or only its frontal part situated in the direction of the panel to be excavated thus isolating its back part from any invasion. Thus, it is possible:

a) to fill this slot with a low-strength material (such as a foam of aerated cement, expanded polyurethane, fibrocement, for example) which is very easy to dispose of afterwards;

b) to close this slot temporarily in a reversible manner, either by means of an expansible member (inflatable shuttering or tube for example) coming to bear after expansion against the walls so as to oppose the entry of foreign material;

or by means of an extractable member (tube or shaped section for example) capable of sliding in the slot.

In the first case, it is sufficient to deflate the member in order to extract it without having to exert a high traction force. In the second case, the tube or shaped section will have to be forcibly extracted in order to overcome frictional forces.

c) to "close" the entry of the slot by means:

either of a "consumable" seal which will be torn away or disposed of afterwards by the first guiding means progressively as it advances;

or of a permanent seal which will be raised, moved aside or compressed by the first guiding means such as a lipped seal, a foam seal, etc.

In order to dispose of possible obstacles of set material it is possible:

d) to clean the slot before inserting into it the guiding means associated with the excavation tool by means of a rotary, percussive or roto-percussive boring tool with or without injection of circulation fluid or by means of a tool for driving under pressure, inserted into this slot until it clears the latter over its height;

e) to clean the slot progressively as the excavation tool advances by means of an auxiliary tool (such as milling wheel, cutting chain, percussive tool, rotary tool, etc.) engaged in the slot and coming to clear the passage for the guiding means associated with the excavation tool and located above it. In this last case, the tool for removal of the obstacles may, either circulate in the slot with no direct mechanical link with the excavation tool, or be securely attached to the excavation tool.

The guiding means used in the process of the invention serve to prevent the adjacent ends of two successive panels forming the cast wall from diverging with respect to one another either in a direction transverse to the plane of the wall or in the plane of the wall itself.

The process of the invention is particularly well suited to the case where the excavation tool is a continuous excavating machine comprising contra-rotating bull wheels or cutting chains. With such a machine, it is in fact very easy to create a force tending to keep the guiding means mutually engaged, by acting on the relative speeds of the bull wheels or cutting chains, that is to say by causing the bull wheel(s) or cutting chain(s) to turn more quickly creating, by friction against the ground, a force orientated towards the previously constructed wall panel.

The correct control of the excavation tool may be monitored by means of inclinometers and possibly by means of proximity detectors installed in the excavation machine.

In the case where the excavation tool is a discontinuous excavating machine, of the type with a grab, the control is more difficult to ensure.

It may be attained, however, by acting on the offsetting of the center of gravity of the grab or by coming to seek a horizontal reaction against the ground at the end of the trench in the course of excavation opposite to that of the guiding means associated with the excavation tool.

The invention also relates to an excavation tool suited to the implementation of the abovementioned variant e) of the process of the invention. This tool, of the continuous excavating machine type having chains or wheels, is characterized in that it comprises at least one guiding means and at least one auxiliary tool attached to said tool and engageable in a guiding slot or groove cooperating with the guiding means of the excavation tool in order to remove any possible obstacles therein, said guiding means being freely disengageable from said guiding slot or groove along the entire length of the latter.

The auxiliary tool may be as described in variant e) and may either be disposed underneath the guiding means attached to the excavation tool, or itself serve as guiding means.

It should lastly be noted that, although guiding means consisting of one or two vertical members, of flat general shape, securely attached to the excavation tool and capable of sliding in one or two stationary slots, have been more particularly described above, these guiding means could be reversed. In other words, the excavation tool could bear one or two members forming a slot or slots capable of coming to engage, in a slidable manner, on one or two rib(s) or rail(s) securely attached to the end of the previously executed panel or to a temporary shuttering joined to said end and extending vertically over the height of said panel or shuttering.

Equally, the vertical member of flat general shape used as one of the guiding means could be replaced by a small wheel or a disk capable of rolling at the bottom of a U-shaped, V-shaped or semicircular groove constituting the other guiding means.

BRIEF DESCRIPTION OF THE DRAWINGS

The following reference description, given with reference to the attached drawings, will give a clear understanding of the invention. In the drawings:

FIG. 1 shows a panel 1 previously cast in the ground after a shaped end shuttering 2 has been put in place.

This shuttering, usually of metal, is provided with a vertical slot 3 extending over its entire length and in the vicinity of its central part. The excavation of the trench where the following panel will be cast is performed with the aid of an excavation tool 4, such as a cutting machine of the continuous excavation type, to which is attached a metal plate 5 serving as guiding means. This plate 5 is engaged in the slot 3 at the start of the excavation operation and slides freely in it from top to bottom progressively as the tool penetrates into the ground, avoiding any transverse deviation of the tool with respect to the shuttering. Moreover, a force, orientated in the direction of the arrow F, is generated by an appropriate control of the tool 4 and keeps the plate 5 engaged in the slot 4 during the excavation operation, thus preventing any deviation of the tool in the actual plane of the trench in the course of execution.

Figure 1:
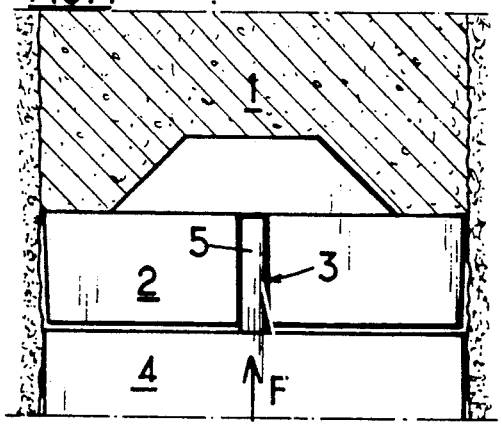
FIG. 1 is a diagrammatic plan view showing one mode of implementing the guiding process of the invention.
Figure 2:
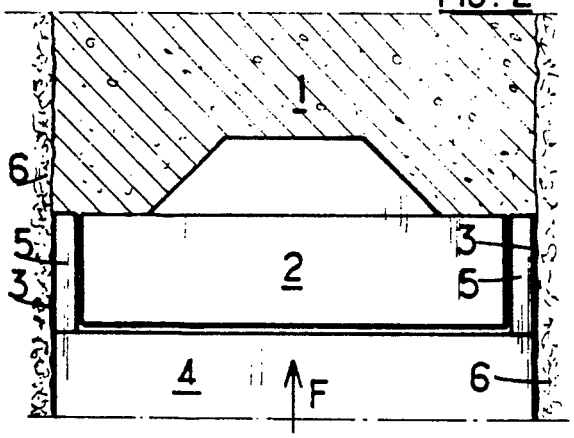
FIG. 2 is a diagrammatic plan view showing another mode of implementing the guiding process of the invention.

FIG. 2 shows a method of guiding similar to that of FIG. 1 except that an excavation tool 4 is called upon which comprises two guiding plates 5 disposed laterally, engaged in two slots 3 provided between the edges of the shuttering and the ground 6 itself. During the excavation of the next trench, the plates 5 of the tool guide the latter while sliding in the slots 3. As previously, care is taken to create a force F tending to urge the tool against the shuttering so as to keep the plates 5 engaged in the slots 3.

In order for the guiding process of the invention to give satisfaction, it is necessary either to avoid the invasion of the slot(s) by concrete or by cement grout which would form obstacles preventing the free sliding of the guiding means in one another, or to allow this invasion to happen but to dispose of the obstacles formed in the slot or slots before performing the excavation of the next trench.

FIGS. 3 to 8 show various means making it possible to prevent the invasion of the slot or slots.

Figure 3A:
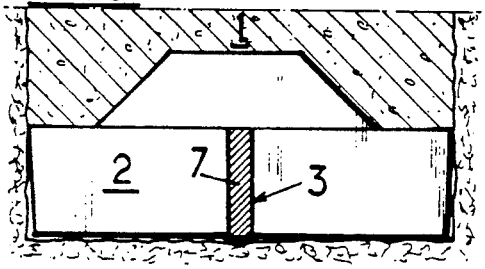
FIGS. 3 to 8 are diagrammatic plan views showing various means for protecting guiding slots against invasion by a setting material.
Figure 3B:
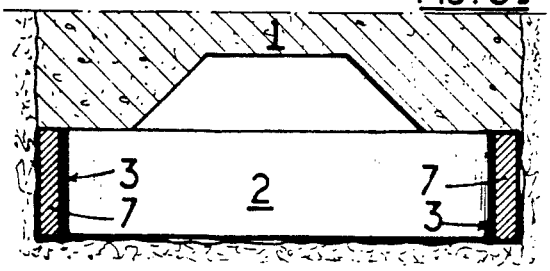

FIGS. 3*a* and 3*b* show the use of a filling of the slot or of the slots with a material 7 of low mechanical strength, polyurethane foam for example, which can easily be disposed of and removed afterwards. This filling is performed before the shuttering 2 is put into place in the ground and before concreting of the panel 1 so as to prevent any invasion of the slot or slots by a setting material capable of forming obstacles.

Figure 4:
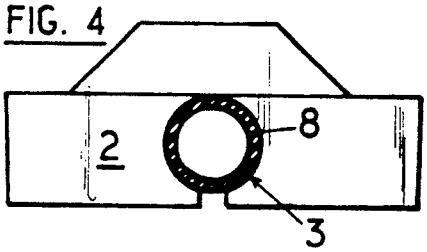

FIG. 4 shows the temporary obstruction by an inflatable tube 8 of a guiding slot 3 of circular cross section. The tube 8 is deflated and extracted from the slot before engagement of the guiding plate securely attached to the excavation tool.

Figure 5:
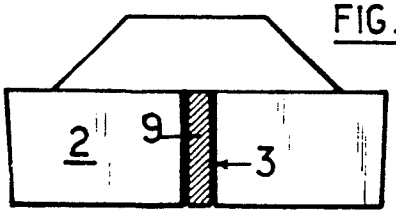

FIG. 5 shows the use of an extractable filling member 9, such as a metal plate, for temporarily closing the slot and protecting it against any invasion. This extractable member is forcibly extracted before engaging the guiding plate attached to the excavation tool in the slot.

Figure 6:
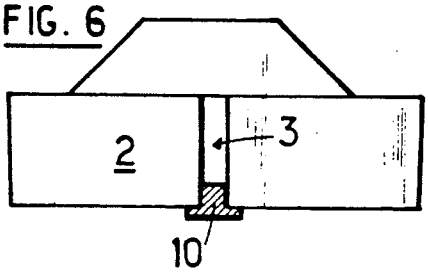

FIG. 6 shows the use of a plug seal 10 in order to close the entry of the slot and to prevent its invasion. This plug seal will be disposed of before engaging the guiding plate in the slot.

Figure 7:
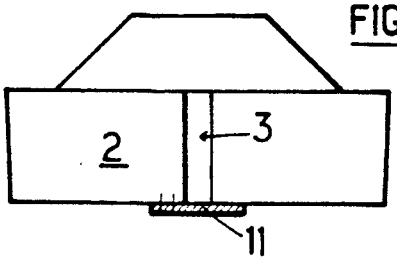

FIG. 7 shows the use of a valve 11 attached to the shuttering, on one side only of the slot, so as to prevent the invasion of the slot. This valve will be moved away by the guiding plate progressively as it slides in the slot.

Figure 8:
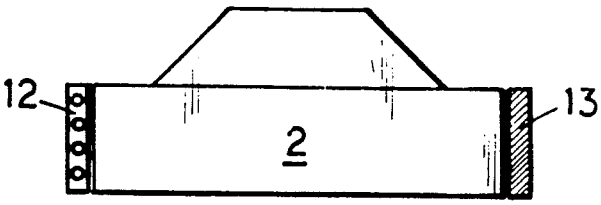

FIG. 8 shows the use of an inflatable member 12 and/or of an extractable member 13 in order to close temporarily lateral slots made between a shuttering and the ground (case of the mode of implementation of FIG. 2).

FIGS. 9 to 12 show various means for disposing of the obstacles formed in the slot or slots in the case where the latter have been allowed to be invaded, so as to render it or them suitable for their guiding function.

Figure 9A:
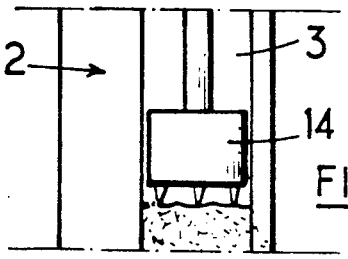
Figure 9B:
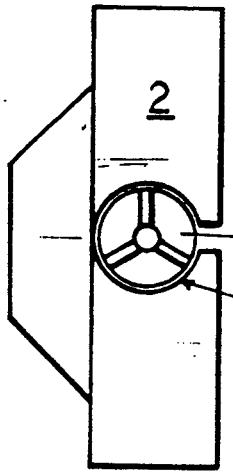

FIGS. 9*a* and 9*b* are elevation and plan views, respectively, showing the clearing of a slot of circular cross section invaded by a set material, with the aid of a rotary drilling tool 14 operated from the surface, before the excavation tool is put in place.

Figure 10A:
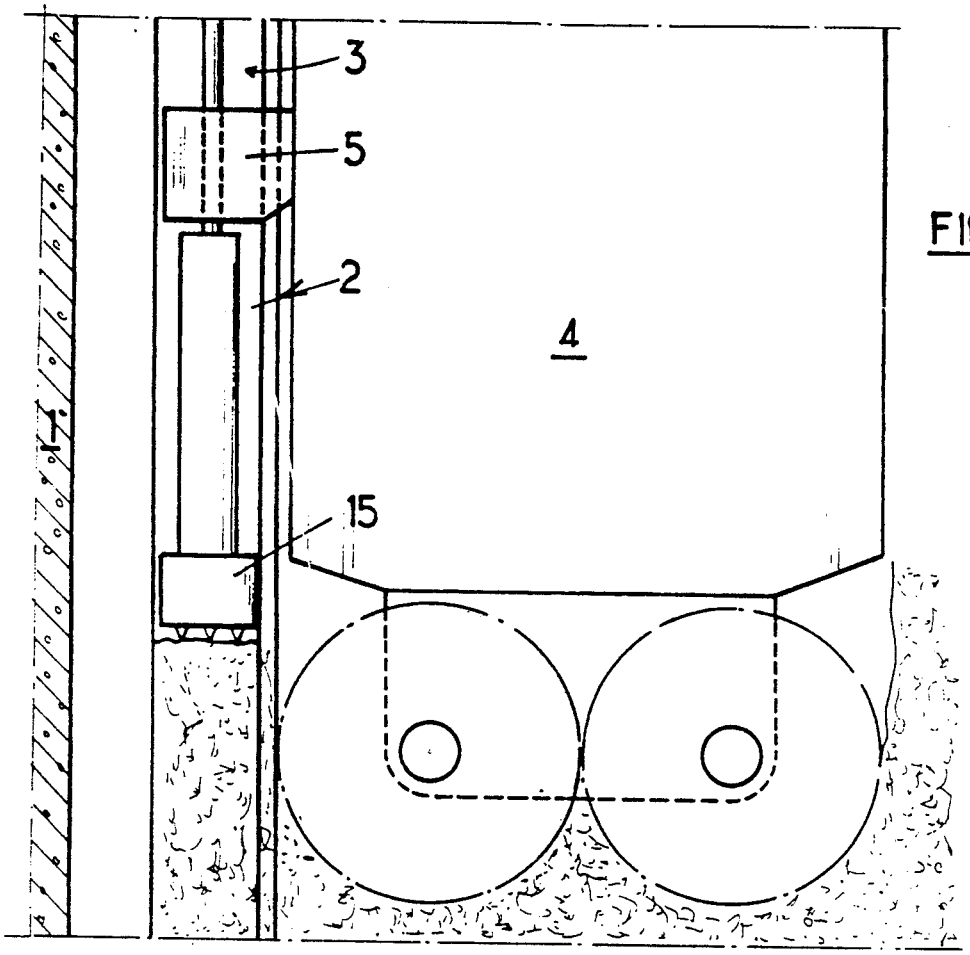
FIGS. 9 to 12 are diagrammatic plan views or elevations showing various means for disposing of material having invaded the guiding slot or slots and having set.
Figure 10B:
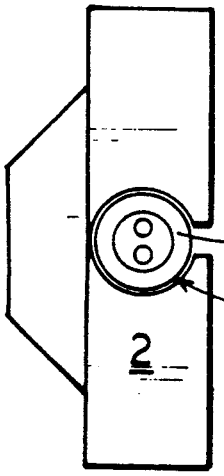

FIGS. 10*a* and 10*b* are elevation and plan views, respectively, showing the clearing of a slot of circular cross section invaded by a set material, with the aid of a percussive drilling tool 15, such as a hammer of the hole bottom type, independent of the excavation tool but working at the same time as the excavation tool so as to clear the slot progressively as the excavation tool penetrates into the ground.

Figure 11A:
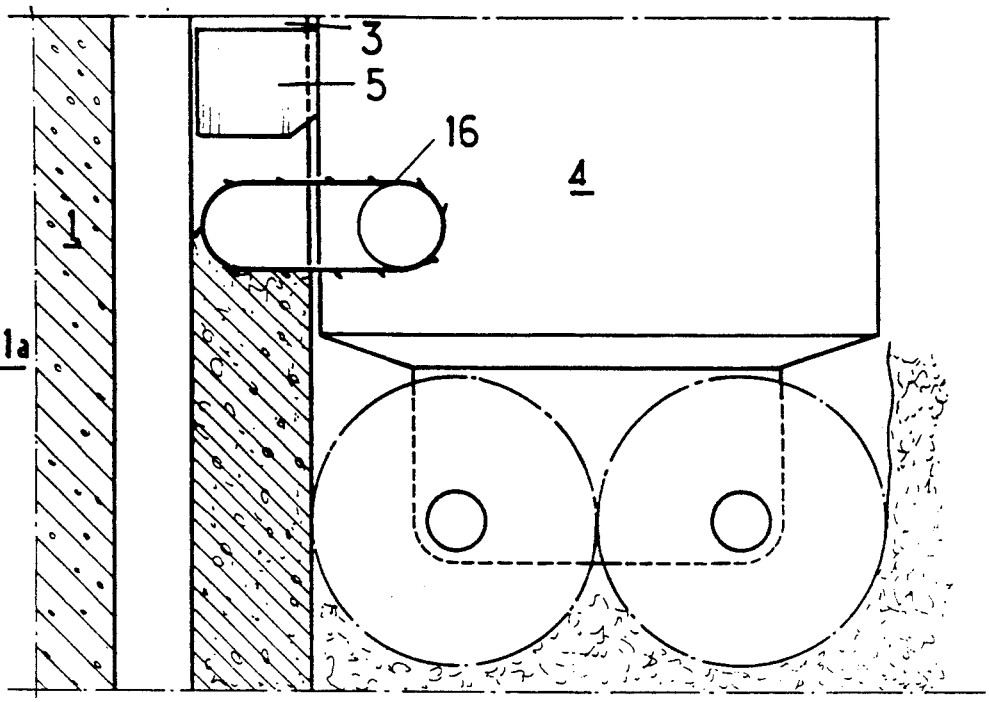
Figure 11B:
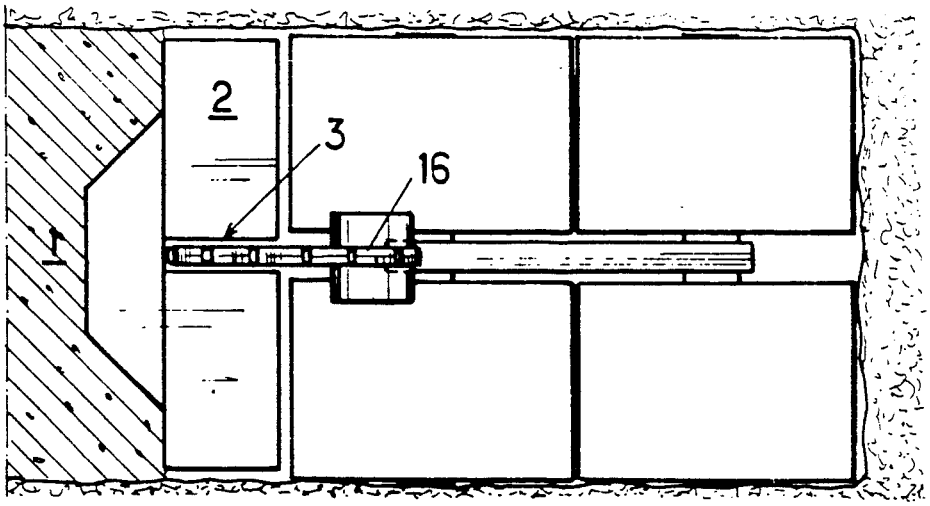

FIGS. 11*a* and 11*b* are elevation and plan views, respectively, showing the clearing of a slot provided in the central part of a shuttering and invaded by a set material, with the aid of a cutting chain 16, mounted on the excavation tool at a level lower than that of the guiding plate, which clears the slot progressively as the excavation tool penetrates into the ground. The cutting chain may be driven by the same motor as that which actuates the excavation tool or by a different motor.

Figure 12:
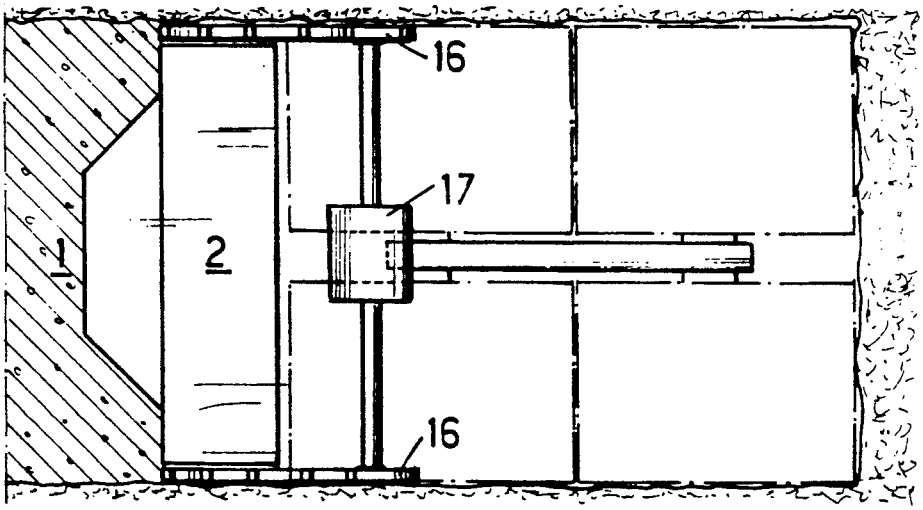

FIG. 12 is a plan view showing the clearing of lateral slots invaded by a set material with the aid of two cutting chains 16, similar to that of FIGS. 11*a* and 11*b*, but disposed on the sides of the excavation tool. The two chains may be driven by a mechanism 17 driven by the same motor as that which actuates the excavation tool or by a different motor.

It should be noted that the chains 16 may serve as first guiding means so that the guiding plates may be omitted.

It should also be noted that the cutting chains could be replaced by milling wheels.

Furthermore, the cutting chains (or the milling wheels) described in connection with FIGS. 11 and 12 could be used in order to dispose of the fillings of low-strength material described in connection with FIGS. 3 or 8.

Lastly, it should be noted that the mode of implementation calling upon two guiding slots made between the edges of the shuttering and the ground may serve to facilitate the subsequent extraction of the shuttering when a shuttering of the type described in EP-A-0,101,350 is used. In fact, said slots facilitate the circulation of the shuttering removal tool used jointly with said shuttering.

It is self-evident that the embodiments described are only examples and that they could be modified in particular by substitution of equivalent techniques without thereby going beyond the scope of the invention.

We claim:

1. A process for guiding an excavating tool used in order to excavate trenches necessary for the construction of a wall cast in the ground, in which:

a) an excavation tool fitted with a first guiding means is provided, b) a second guiding means is provided, said second guiding means being arranges so as to extend substantially over the entire depth of the trench, said first and second guiding means being such that one of said first and second guiding means can slide freely in the other and that they can be mutually engaged and disengaged freely over the entire length of the second guiding means;

(c) constructing the elementary panel of the wall cast in the ground in a previously excavated trench and then (d) after construction of the panel in the previously excavated trench, engaging the first and second guiding means and (e) controlling the excavation tool so as to create a force tending to keep the first and second guiding means mutually engaged while the excavation of a following trench is performed.

2. A process according to claim 1, in which the first guiding means is securely attached to the excavation tool, and consists of a vertical member of flat general shape and the second guiding means is securely attached to the end of a previously constructed panel and consists of a slot extending vertically over the height of said panel.

3. A process according to claim 2, including preventing invasion of the slot by a setting material during the operations prior to the implementation of stage e).

4. A process according to claim 3, in which said preventing step is selected from the group consisting of a) filling the slot with a low-strength material; b) closing the slot temporarily and in a reversible manner; and c) closing the entry of the slot.

5. A process according to claim 2, including disposing of any possible obstacles formed by a setting material having invaded the slot and having hardened therein.

6. A process according to claim 5, in which the obstacles are disposed of simultaneously with the performing of stage (e).

7. A process according to claim 1, in which the guiding means consists of two vertical members, of flat general shape, spaced apart, parallel to one another, securely attached to the excavation tool, and coming to engage, respectively, in two slots provided between the edges of a member securely attached to the end of a previously constructed panel and the neighboring ground.

8. A process according to claim 1, in which the excavation tool is a continuous excavating machine comprising contra-rotating bull wheels.

9. The process of claim 1, wherein the elemental panels forming the wall are successively cast.

10. The process of claim 1, wherein the elemental panels forming the wall are alternatively cast.

11. A process according to claim 1, in which the first guiding means is securely attached to the excavation tool, and consists of a vertical member of flat general shape and the second guiding means is provided as a member securely attached to a temporary shuttering joined to an end of a previously constructed panel, and consists of a slot extending vertically over the height of said shuttering and in the vicinity of the central part of the shuttering.

12. A process according to claim 1, in which the guiding means consists of two vertical members, a flat general shape, spaced apart, parallel to one another, securely attached to the excavation tool, and coming to engage, respectively, in two slots provided between the edges of a member securely attached to a temporary shuttering joined to the end of a previously constructed panel and the neighboring ground.

13. A process according to claim 1, in which the excavation tool is a continuous excavating machine comprising cutting chains.

* * * * *